US007743968B2

(12) United States Patent
Theelen

(10) Patent No.: US 7,743,968 B2
(45) Date of Patent: Jun. 29, 2010

(54) CARTON HAVING MULTI-PLY HANDLE

(75) Inventor: Marcus Theelen, Kreuzau (DE)

(73) Assignee: Graphic Packaging International, Inc., Marietta, GA (US)

( * ) Notice: Subject to any disclaimer, the term of this patent is extended or adjusted under 35 U.S.C. 154(b) by 663 days.

(21) Appl. No.: 11/196,081

(22) Filed: Aug. 3, 2005

(65) Prior Publication Data

US 2007/0029371 A1 Feb. 8, 2007

(51) Int. Cl.
*B65D 5/46* (2006.01)
*B65D 17/00* (2006.01)

(52) U.S. Cl. ..... 229/117.13; 229/122; 229/242

(58) Field of Classification Search ..... 229/117.13, 229/242, 117.18, 920, 117.14; 206/141, 206/163

See application file for complete search history.

(56) References Cited

U.S. PATENT DOCUMENTS 3,894,681 A * 7/1975 Arneson et al. ..... 221/305
3,904,036 A * 9/1975 Forrer ..... 206/427
4,364,509 A * 12/1982 Holley et al. ..... 221/305
4,405,078 A * 9/1983 Dutcher et al. ..... 229/117.13
4,588,084 A * 5/1986 Holley, Jr. ..... 206/427
5,119,985 A 6/1992 Dawson et al.
5,379,944 A * 1/1995 Stout et al. ..... 229/117.13
6,131,803 A * 10/2000 Oliff et al. ..... 229/117.13
6,766,940 B2 7/2004 Negelen
2002/0088820 A1* 7/2002 Spivey ..... 221/305
2003/0136820 A1* 7/2003 Negelen ..... 229/117.13
2005/0056658 A1 3/2005 Spivey

FOREIGN PATENT DOCUMENTS

DE 201 12 228 U1 11/2002
WO WO 96/27538 12/1996
WO WO 99/28207 6/1999
WO WO 00/78618 A1 12/2000
WO WO 01/66434 A1 9/2001
WO WO 03/037742 A2 5/2003

* cited by examiner

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A blank and carton having a reinforced handle are provided.

29 Claims, 6 Drawing Sheets

CARTON HAVING MULTI-PLY HANDLE

BACKGROUND

Cartons used to contain multiple containers, such as beverage containers, often are heavy and difficult to carry. Thus, there is a continuing need for improved cartons that are easy to carry and robust enough to support the weight of the containers carried therein.

SUMMARY

The present invention is directed generally to a carton that may be used with, for example, cans and bottles of the types used to contain soft drinks, beer and the like. The carton includes a multi-ply handle that provides improved strength and comfort for the user carrying the carton with the containers therein.

BRIEF DESCRIPTION OF THE DRAWINGS

The description refers to the accompanying drawings in which like reference characters refer to like parts throughout the several views, and in which.

DETAILED DESCRIPTION

The present invention may be best understood by referring to the following figures. For purposes of simplicity, like numerals may be used to describe like features. However, it should be understood use of like numerals is not to be construed as an acknowledgement or admission that such features are equivalent in any manner.

Figure 1:
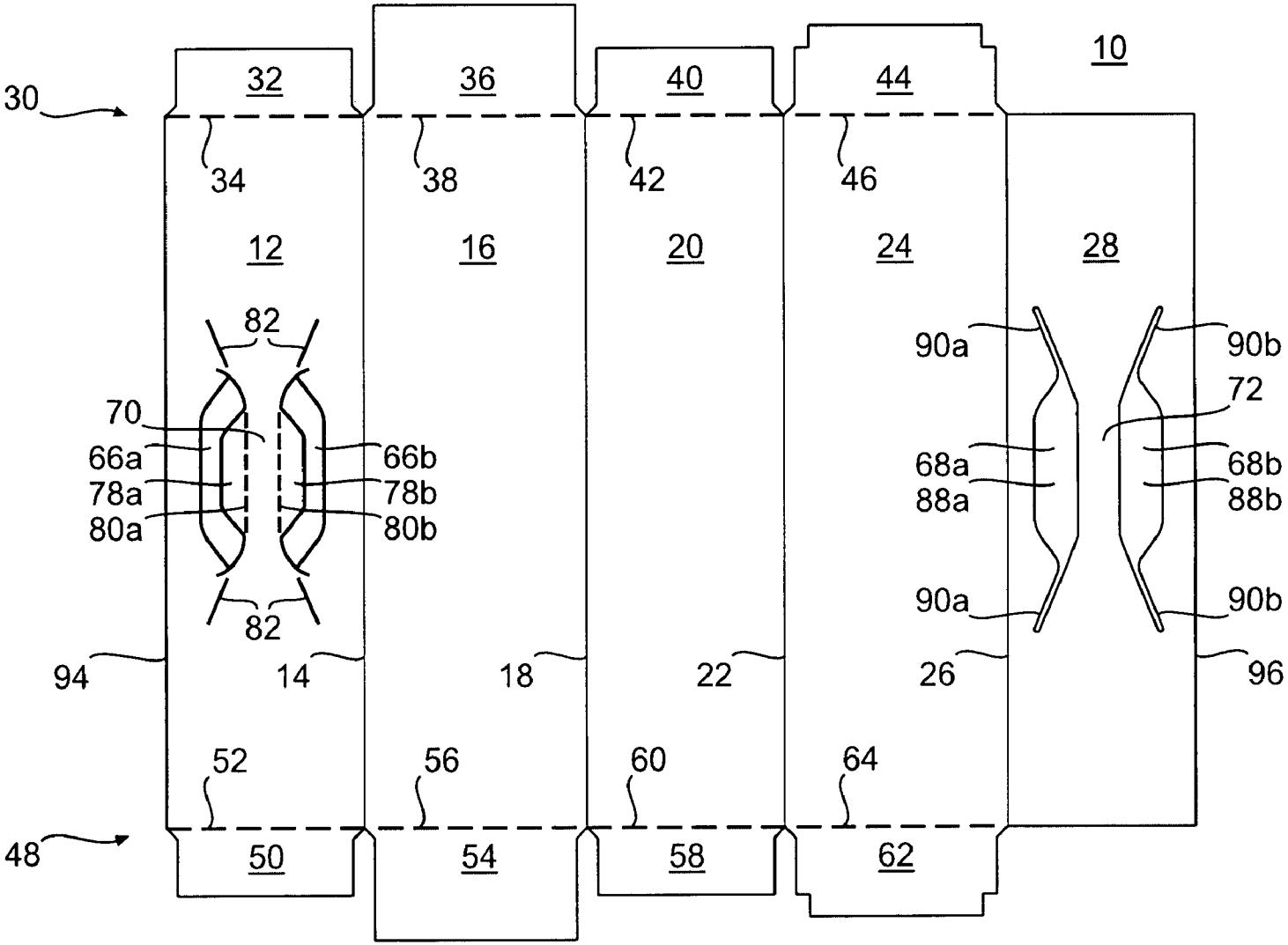
FIG. 1 is a plan view of an exemplary blank from which a carton may be formed, according to the present invention.

According to one aspect of the present invention depicted in FIG. 1, an exemplary blank 10 is provided. The blank 10 includes a top panel 12 that is connected by fold line 14 to side panel 16, which in turn is connected by fold line 18 to bottom panel 20. Bottom panel 20 is connected by fold line 22 to side panel 24, which in turn is connected by fold line 26 to reinforcing panel 28. The exemplary blank 10 can be folded into a carton that is capable of containing cans or bottles, for example, in two rows of six containers each, as will be discussed below. It will be understood by those of skill in the art that while particular exemplary blanks and cartons are shown and described herein, the various aspects of the present invention may be used with any carton, as needed or desired. Thus, numerous blanks and cartons are contemplated hereby.

At a first end 30 of the carton blank 10, a top end flap 32 is joined to top panel 12 at fold line 34. Side end flap 36 is joined to side panel 16 at fold line 38. Bottom end flap 40 is joined to bottom panel 20 at fold line 42. Side end flap 44 is joined to side panel 24 at fold line 46.

At a second end 48 of the blank 10, a top end flap 50 is joined to top panel 12 at fold line 52. Side end flap 54 is joined to side panel 16 at fold line 56. Bottom end flap 58 is joined to bottom panel 20 at fold line 60. Side end flap 62 is joined to side panel 24 at fold line 64.

Still viewing FIG. 1, the blank 10 includes openings 66*a*, 66*b* (collectively "66") and 68*a*, 68*b* (collectively "68") formed in corresponding locations in top panel 12 and reinforcing panel 28, respectively. Handle openings 66*a*, 66*b* define a handle 70. In this example, handle 70 is substantially elongated or rectangular in shape. It will be understood that numerous shapes are contemplated hereby including, but not limited to, arcuate, double-arcuate, crescent-shaped, oval, or any other shape. The openings 68*a*, 68*b* in the reinforcing panel 28 ("reinforcing openings") define a handle reinforcement panel 72.

Figure 2:
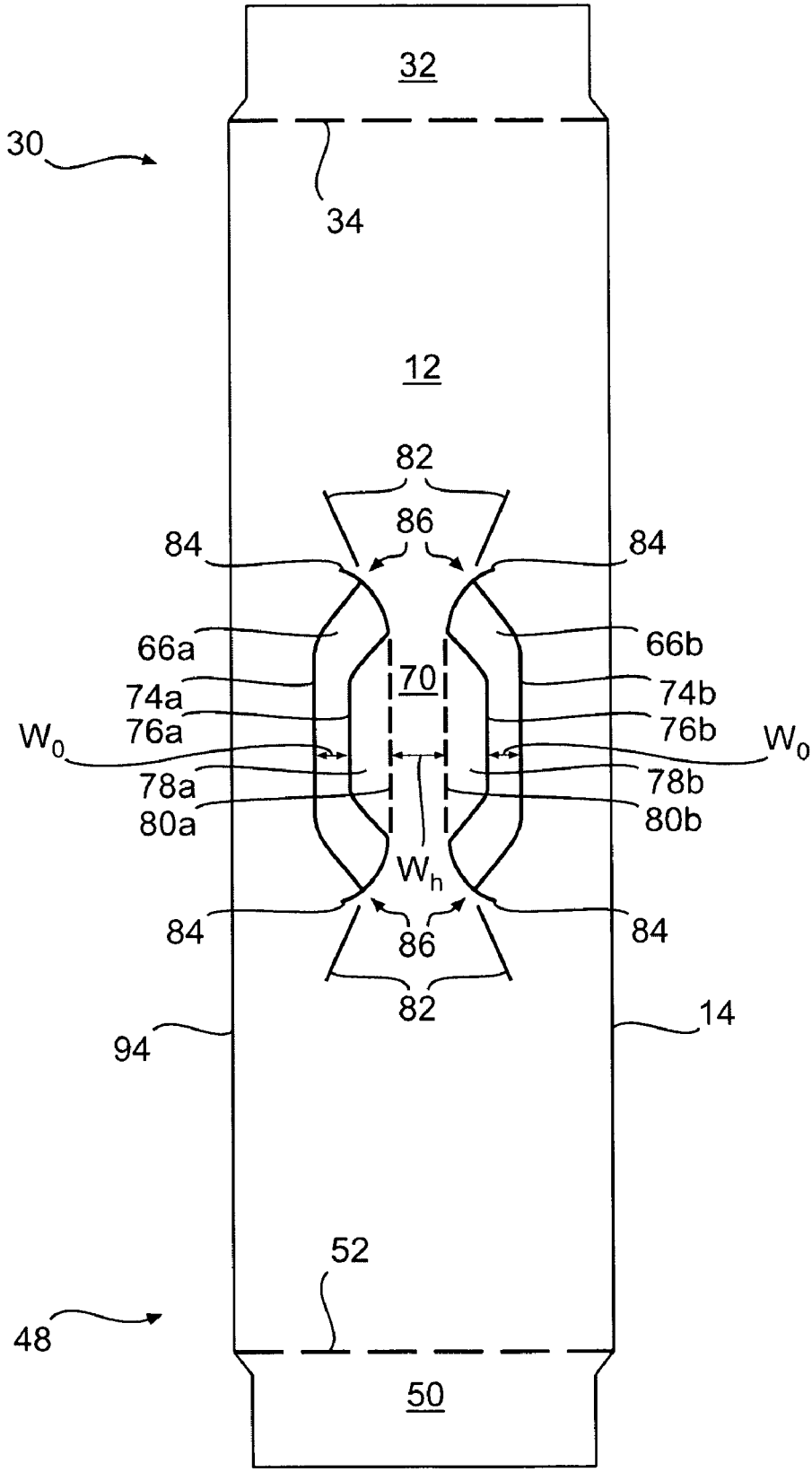
FIG. 2 is an enlarged view of the top panel of the exemplary blank of FIG. 1.

FIG. 2 depicts an enlarged view of the handle 70 and various associated features in top panel 12. The handle openings 66*a*, 66*b* are shown as including a somewhat flattened portion 74*a*, 74*b* and somewhat arched portion 76*a*, 76*b*. Cushioning flaps 78*a*, 78*b* are foldably joined to top panel 12 along the length of handle 70 at fold lines 80*a*, 80*b*, respectively. The flaps 78*a*, 78*b* may be folded toward the interior of the assembled carton to provide a comfortable contact surface for the user carrying the carton. Optionally, stress relieving indentations or creases 82 and J-cuts 84 may extend from the endpoints 86 of the handle openings 66*a*, 66*b*. In this example, the endpoints of the handle openings are shown as being somewhat pointed in shape. However, rounded, squared, or other endpoint shapes are contemplated. Additionally, it will be understood that other handle opening geometries are contemplated hereby. It further will be understood by those of skill in the art that more than one handle may be provided, and that such one or more handles may be provided in any of the various panels and on any of the sides of the resulting carton. Thus, while certain handle configurations are depicted and described herein, numerous configurations are contemplated hereby.

Figure 3:
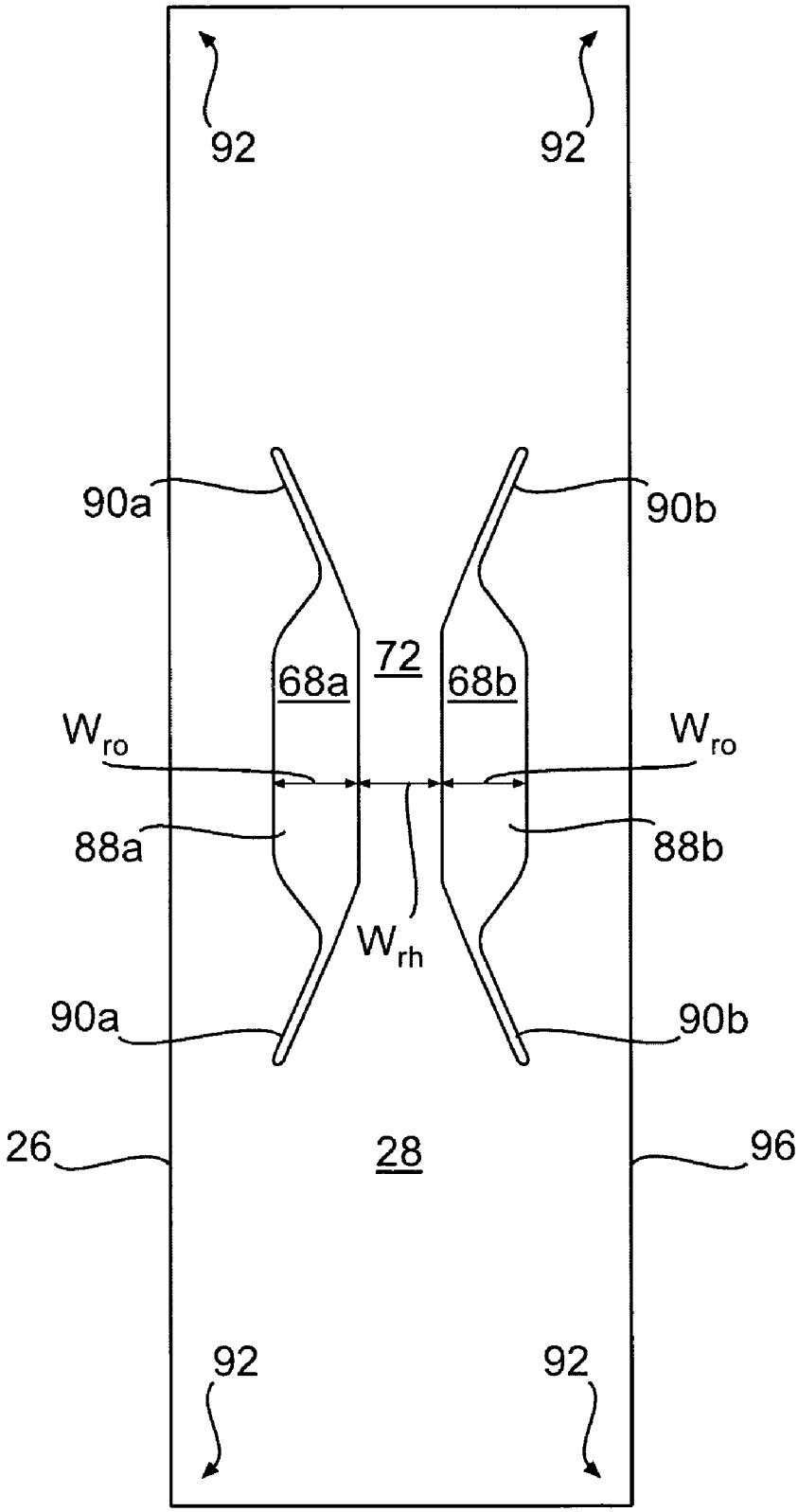
FIG. 3 is an enlarged view of the reinforcing panel of the exemplary blank of FIG. 1.

Turning to FIG. 3, an enlarged view of the reinforcing openings 68*a*, 68*b* and associated features in the reinforcing panel 28 is provided. The reinforcing openings 68*a*, 68*b* include a major portion 88*a*, 88*b* and elongate extensions 90*a*, 90*b*, which extend diagonally generally toward the corners 92 of the panel 28. As illustrated in FIG. 3, each of the extensions 90*a*, 90*b* may be formed, for example, by cutting and removing a portion of the material from which the blank 10' is formed, such that the extensions 90*a*, 90*b* are wider than a slit. Alternatively, however, the extensions may be smaller in width, and in some instances, may be in the form of a slit.

To form the blank 10 into a carton, top panel 12 is overlapped or superposed with and glued to reinforcing panel 28, such that edge 94 is aligned with fold line 26 and edge 96 is aligned with fold line 14. Thereafter, the carton 98 can be erected by folding along fold lines 14, 18, and 22 to form a sleeve with ends 30 and 48 being open.

FIGS. 2 and 3 illustrate the general relationship between the openings 66 and 68 in the top panel 12 and reinforcing panel 28, respectively. The reinforcing openings 68 may be dimensioned so that when the top panel 12 and the reinforcing panel 28 are superposed, the reinforcing openings 68 respectively are aligned with, without occluding, the handle openings 66. Likewise, the elongate extensions 90 are aligned generally with creases 82. The reinforcing openings 68 may be substantially identical in shape and dimensions, or may be larger in dimensions, than the handle openings 66. More particularly, the handle 70 may have a width Wh substantially equal to the width Wrh of the reinforcing handle panel 72. Each handle opening 66 may have a width Wo that is substantially equal to or less than the width Wro of each reinforcing opening 68. In this manner, when the top panel 12 and reinforcing panel 28 are superposed, the reinforcing panel 28 does not impede insertion of the user's fingers into the handle openings 66 for use of the handle 70.

In one aspect, the top panel 12 and reinforcing panel 28 are superposed such that the reinforcing panel 28 is positioned inwardly toward an interior of the carton 98 and the top panel 12 is positioned outwardly toward an exterior of the carton 98. By overlapping the top panel 12 with the reinforcing panel 28 in this manner, the top panel 12 is provided with additional strength and support. Likewise, with the openings 66 and 68 aligned, the handle 70 is reinforced, thereby imparting additional strength and integrity to the handle 70. As a result, the carton features greater strength and durability relative to a carton with a single-ply panel and/or handle.

The cans or bottles then can be loaded into the carton on their side and the various end flaps on both ends are closed. Various methods of closing the carton are contemplated. Generally, the various flaps 32, 36, 40, 44, 50, 54, 58, 62 are folded in a direction toward the interior of the carton 98 to be formed and glued as needed. The terms "glue" and "glued" are intended to encompass any adhesive or manner or technique for adhering materials as are known to those of skill in the art. While use of the terms "glue" and "glued" are used herein, it will be understood that other methods of securing the various flaps are contemplated hereby.

According to another aspect of the present invention depicted in FIGS. 4-7, the blank and carton formed therefrom may include one or more dispensing features for readily removing a container from the carton. The blank 10' of FIG. 4 includes some features similar to that of FIG. 1. Thus, for simplicity, similar features are labeled with the same reference numerals as used in FIG. 1. However, it will be understood that numerous dispensing features and other features may be used in accordance with the present invention.

Figure 4:
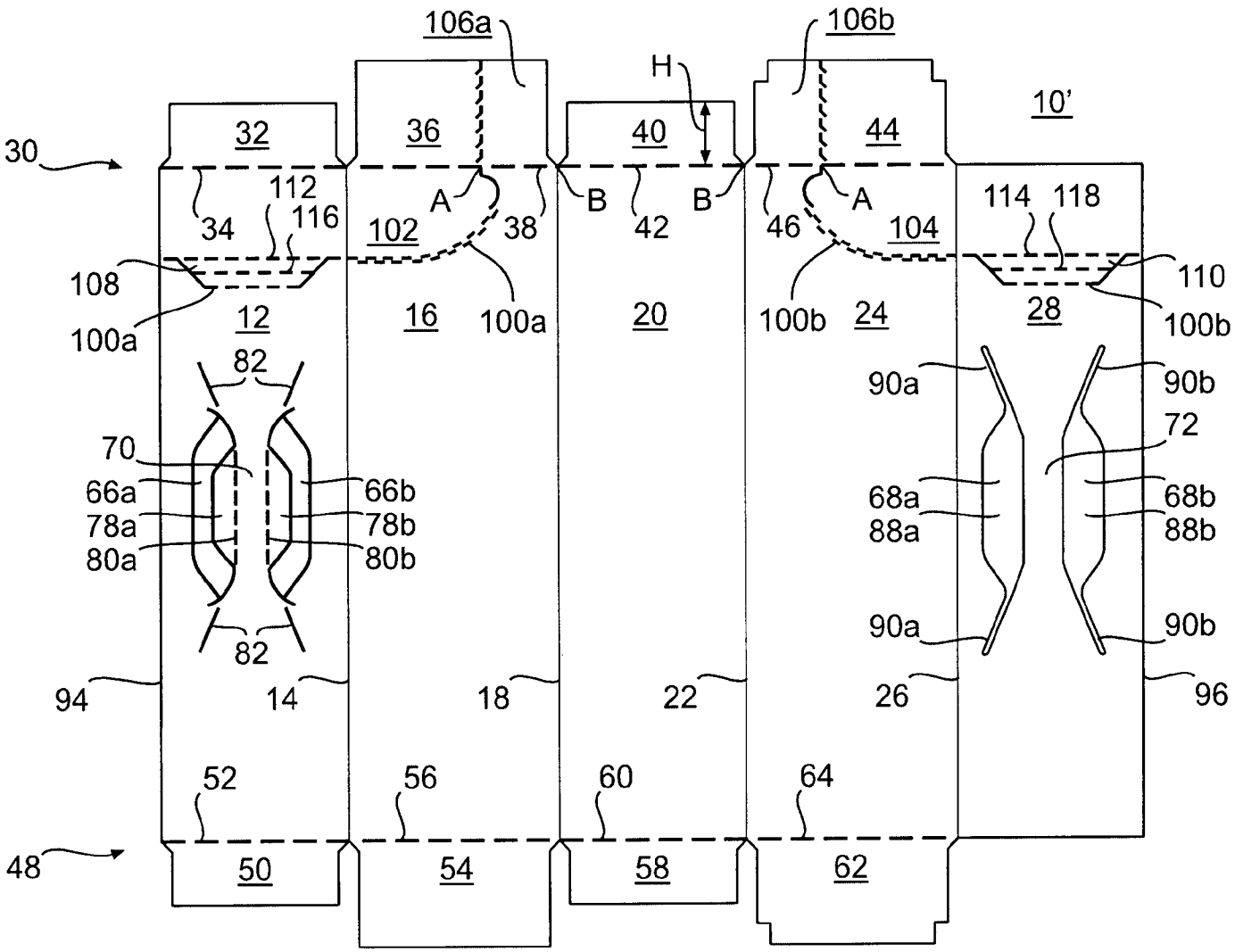
FIG. 4 is a plan view of another exemplary blank from which a carton may be formed, according to the present invention.

Initially viewing FIG. 4, the blank 10' includes a first, exiting end 30 and a second, closed end 48. In this example, the blank 10' includes tear line 100 (FIGS. 4-7) defined by tear line portions 100*a* and 100*b* that extend through top panel 12 and reinforcing panel 28 to form triangular dispensing flaps 102 and 104, respectively, and continue through side panels 16 and 24 into the side end flaps 36 and 44, respectively, to form a dispenser 126 (see FIG. 5). To facilitate the opening of the dispenser 126, aligning finger flaps 108 and 110 may be provided in the top panel 12 and reinforcing panel 28, respectively, for the easy insertion of the fingers or another implement to initiate the forming of the dispenser 126.

Finger flap 108 is connected to top panel 12 at fold line 92, and finger flap 110 is connected to reinforcing panel 28 at fold line 114. If desired, finger flaps 108 and 110 may be provided with respective insertion flaps 116 and 118 to facilitate entry of the fingers into the carton when assembled (FIG. 5).

Figure 5:
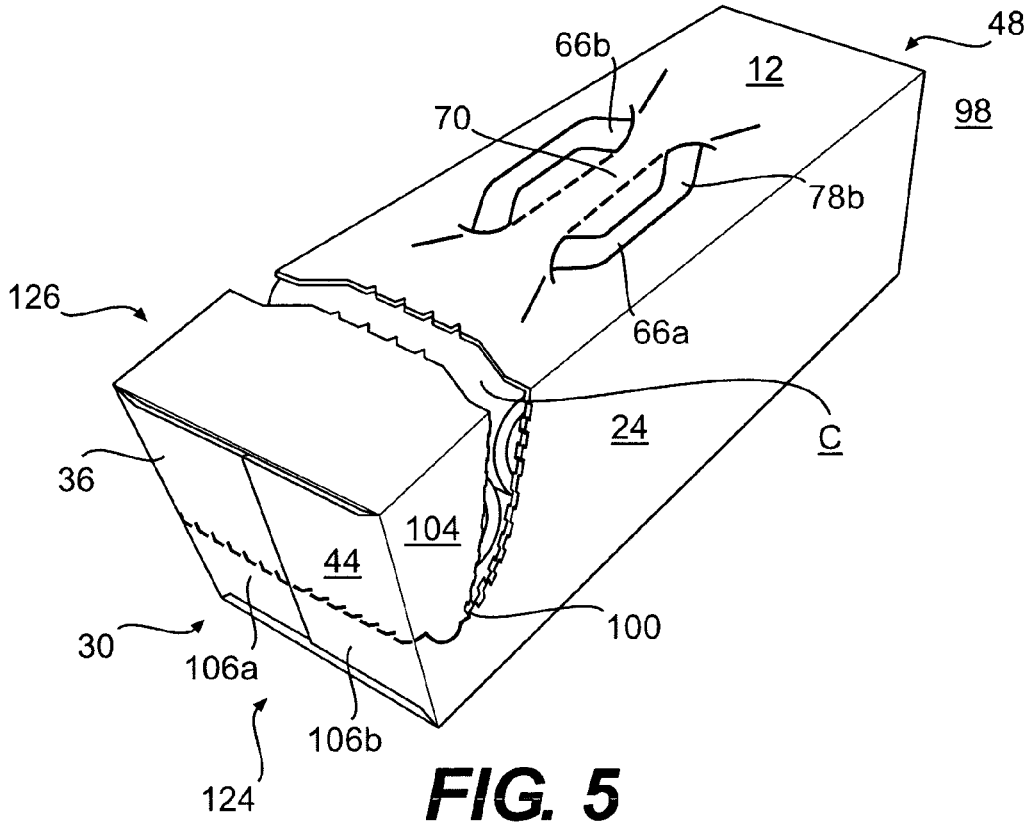
FIG. 5 is a perspective view of an exemplary carton that may be formed according to the present invention, showing a partially opened dispenser.

FIG. 5 illustrates an exemplary carton 98 formed from blank 10' according to the present invention. The carton 98 is filled with beverage cans C and the dispenser 126 is open partially. It will be noted that the dispenser is a unitary structure. The dispenser 126 is opened by a person inserting his or her fingers through overlapping finger flaps 108 and 110 and pulling the dispenser 126 open. In one aspect, finger flaps 108 and 110 are positioned so that the fingers will enter the interior of the carton 98 between the first and second cans.

Figure 6:
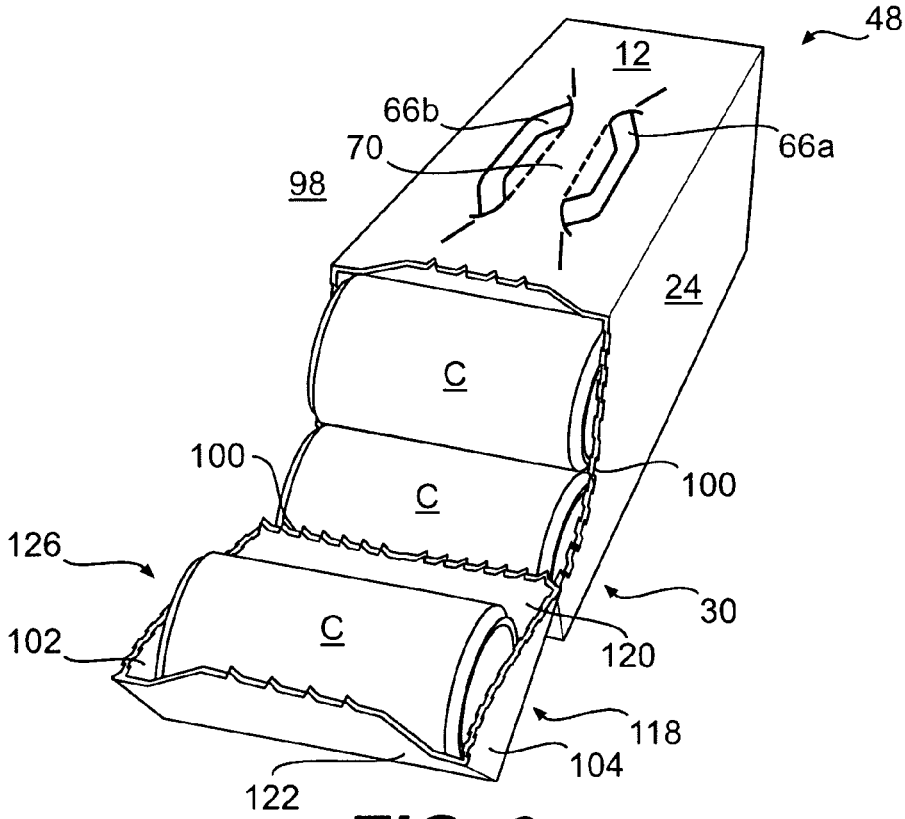
FIG. 6 is a perspective view of the exemplary carton of FIG. 3 with the dispenser open and containing a can.

FIG. 6 shows the dispenser 126 completely opened but still attached to the carton 98 by tear line 100 not being torn open through side end flaps 36 and 44. When the dispenser 126 is completely opened, the top can C will fall into the dispenser 126 and will be retained. Thus, the dispenser 126 prevents the can C from leaving the vicinity of the carton 98. The dispenser 126 forms a basket 118 with triangular flaps 102 and 104 forming side walls thereof, side end flaps 36 and 44 forming a bottom wall 120 and the torn off portions of the top flaps 12 and 28 forming an end wall 122. End wall 122 formed from the top panel 12, is multi-ply, thereby providing additional strength to the dispenser 126.

Figure 7:
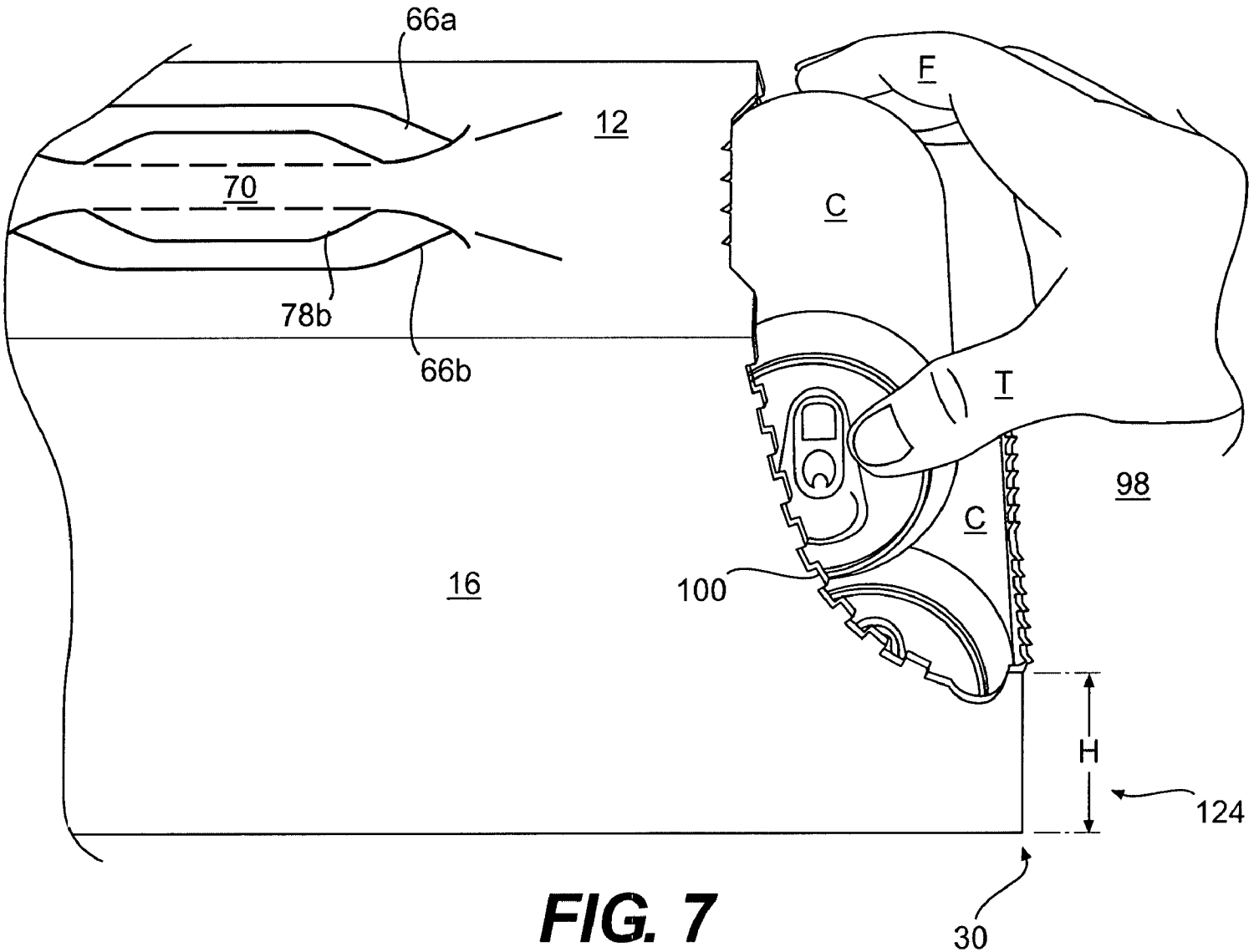
FIG. 7 is a perspective side view of the carton of FIGS. 4 and 5 illustrating removal of a can therefrom.

To maintain the structural integrity of this carton, the bottom portions 106*a*, 106*b* of the side end flaps 36 and 44 are not removed from the carton 98 when the dispenser 126 is detached partially or completely. Additionally, in one aspect, the bottom end flap 40 has a height H (FIG. 2) approximately equal to the distance between A and B along fold lines 38 and 46, respectively. Thus, the bottom end flap 40 has substantially the same height as the bottom portions 106*a*, 106*b* of the side end flaps 36 and 44, thereby producing a strong bottom end structure 124. As shown in FIG. 7, the height H of the bottom end structure 124 formed by panels 40, 106*a*, and 106*b* is less than the diameter of a can C. If desired, the dispenser 126 can be detached from the carton 98, or may remain attached along tear line 100, and reclosed.

As illustrated in FIG. 7, a can C can be easily removed from the carton 98 by using the fingers F and the thumb T of a hand. The exemplary cartons and dispenser shown herein may be used for cans or other types of cylindrical containers. Some of such cartons and dispensers may be particularly useful for PET bottles having a stubby configuration.

According to the various aspects of the present invention described herein or contemplated hereby, the blank and carton may be formed from a foldable sheet material. In one aspect, the blank is formed from paperboard. In another aspect, the blank may be formed from paperboard having a basis weight of at least about 100 pounds per ream. In another aspect, the blank may be formed from paperboard having a thickness of at least about 0.012 inches. The blank, and thus the carton formed therefrom, also may be constructed from other materials, for example, cardboard or any other suitable material. In the exemplary embodiments discussed above, the blanks are formed from coated solid unbleached sulfate board, such as SUS® board, commercially available from Graphic Packaging International. In general, the board may have a caliper in the range of from about 18 to about 30, for example, 26. If needed or desired, the blank may be laminated to or coated with one or more different or similar sheet-like materials at selected panels or panel sections.

Optionally, one or more panels of the blanks and cartons discussed herein may be coated with varnish, clay, or other materials, either alone or in combination. The coating may then be printed over with product, advertising, and other information or images. The blanks also may be coated to protect any information printed on the blank. The blanks may be coated with, for example, a moisture barrier layer, on either or both sides of the blanks.

It will be understood that in each of the various blanks and cartons described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. Where cutting is used to create a fold line, the cutting typically will not be overly extensive in a manner that might cause a reasonable user to consider incorrectly the fold line to be a tear line.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks can also be referred to as a cut line, since the nicks typically are a relatively small percentage of the subject line, and alternatively the nicks can be omitted from such a cut line. As stated above, where cutting is used to provide a fold line, the cutting typically will not be overly extensive in a manner that might cause a reasonable user to consider incorrectly the fold line to be a tear line. Likewise, where nicks are present in a cut line (e.g., tear line), typically the nicks will not be overly large or overly numerous in a manner that might cause a reasonable user to consider incorrectly the subject line to be a fold line.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A carton blank comprising:

a top panel, a first side panel, a bottom panel, and a second side panel respectively joined along a plurality of fold lines, the top panel including handle openings defining a handle;

a reinforcing panel contiguous with the second side panel, the reinforcing panel including a pair of opposed reinforcing openings dimensioned to align with the handle openings, wherein a reinforcing handle is defined between the reinforcing openings in the reinforcing panel, and each reinforcing opening comprises a length that extends between opposite first and second tapered ends of the reinforcing opening, so that the length extends from the first tapered end of the reinforcing opening to the second tapered end of the reinforcing opening, and a width positioned between and located distant from the tapered ends, wherein the width extends across, and is smaller than, the length;

a first elongate extension cut out extending from the first tapered end of a first reinforcing opening of the reinforcing openings;

a second elongate extension cut out extending from the second tapered end of the first reinforcing opening;

a third elongate extension cut out extending from the first tapered end of a second reinforcing opening of the reinforcing openings; and a fourth elongate extension cut out extending from the second tapered end of the second reinforcing opening, wherein each of the first, second, third and fourth elongate extension cut outs is in the reinforcing panel, each of the first, second, third and fourth elongate extension cut outs is wider than a slit, and for each elongate extension cut out of the first, second, third and fourth elongate extension cut outs, the elongate extension cut out has a length that extends from the respective tapered end to an opposite end of the elongate extension cut out, and a width that is smaller than both the length of the elongate extension cut out, and the width of the reinforcing opening from which the elongate extension cut extends.

2. The blank of claim 1, wherein the elongate extension cut outs extend obliquely to the lengths of the reinforcing openings in the reinforcing panel.

3. The blank of claim 2, wherein at least one of the handle openings is arcuate.

4. The blank of claim 3, wherein the handle comprises a pair of cushioning flaps, each cushioning flap being foldably joined at one side of the handle, and wherein the handle openings comprises a pair of opposed handle openings.

5. The blank of claim 4, further comprising at least one tear line along at least a portion of the top panel, the first side panel, and the second side panel for forming a dispenser.

6. The blank of claim 2, wherein the width of each reinforcing opening is substantially equal to a width of the handle openings.

7. The blank of claim 1, wherein:

the reinforcing handle includes opposite first and second ends;

the first and third elongate extension cut outs extend away from the first end of the reinforcing handle;

the first and third elongate extension cut outs diverge from one another as the first and third elongate extension cut outs extend away from the first end of the reinforcing handle;

the second and fourth elongate extension cut outs extend away from the second end of the reinforcing handle; and the second and fourth elongate extension cut outs diverge from one another as the second and fourth elongate extension cut outs extend away from the second end of the reinforcing handle.

8. A carton blank comprising:

a plurality of adjoining panels including a first panel at a first end of the blank and a reinforcing panel at a second end of the blank, with additional panels therebetween, wherein each of the first panel and the reinforcing panel comprises a pair of openings, a handle is located between the pair of openings in the first panel and a reinforcing handle is located between the pair of openings in the reinforcing panel, such that when a carton is erected from the blank, the pair of openings in the first panel and the pair of openings in the reinforcing panel are in substantial alignment, a first opening of the pair of openings in the reinforcing panel comprises a length that extends between opposite first and second tapered ends of the first opening, so that the length extends from the first tapered end to the second tapered end, and a width positioned between and located distant from the tapered ends, wherein the width extends across, and is smaller than, the length; and an elongate extension cut out extends from the first tapered end of the first opening of the pair of openings in the reinforcing panel, wherein the elongate extension cut out is in the reinforcing panel, the elongate extension cut out is wider than a slit, and the elongate extension cut out has a length that extends from the first tapered end of the first opening in the reinforcing panel to an opposite end of the elongate extension cut out, and a width that is smaller than both the length of the elongate extension cut out, and the width of the first opening in the reinforcing panel.

9. The blank of claim 8, wherein the handle comprises a pair of cushioning flaps, each cushioning flap being foldably joined at one side of the handle.

10. The blank of claim 8, wherein the pair of openings in the reinforcing panel is equal to or greater in dimension than the pair of openings in the first panel.

11. The blank of claim 8, wherein:

the elongate extension cut out is a first elongate extension cut out, a second opening of the pair of openings in the reinforcing panel comprises a length that extends between opposite first and second tapered ends of the second opening, a width positioned between and located distant from the tapered ends of the second opening, wherein the width of the second opening extends across, and is smaller than, the length of the second opening, the blank further comprises a second elongate extension cut out extending from the first tapered end of the second opening in the reinforcing panel, and a third elongate extension cut out extending from the second tapered end of the second opening in the reinforcing panel, wherein for each elongate extension cut out of the second and third elongate extension cut outs, the elongate extension cut out is in the reinforcing panel, and the elongate extension cut out is wider than a slit, the second elongate extension cut out has a length that extends from the first tapered end of the second opening in the reinforcing panel to an opposite end of the second elongate extension cut out, and a width that is smaller than both the length of the second elongate extension cut out, and the width of the second opening in the reinforcing panel, and the third elongate extension cut out has a length that extends from the second tapered end of the second opening in the reinforcing panel to an opposite end of the third elongate extension cut out, and a width that is smaller than both the length of the third elongate extension cut out, and the width of the second opening in the reinforcing panel.

12. The blank of claim 11, wherein:

the first and second elongate extension cut outs extend away from an end of the reinforcing handle; and the first and second elongate extension cut outs diverge from one another as the first and second elongate extension cut outs extend away from the end of the reinforcing handle.

13. The blank of claim 8, wherein the elongate extension cut out extends obliquely to the length of the first opening in the reinforcing panel.

14. The blank of claim 8, wherein:

the elongate extension cut out is a first elongate extension cut out, a second elongate extension cut out extends from the second tapered end of the first opening of the pair of openings in the reinforcing panel, the second elongate extension cut out is in the reinforcing panel, the second elongate extension cut out is wider than a slit, and the second elongate extension cut out has a length that extends from the second tapered end of the first opening in the reinforcing panel to an opposite end of the second elongate extension cut out and a width that is smaller than both the length of the second elongate extension cut out, and the width of the first opening in the reinforcing panel.

15. The blank of claim 14, wherein:

a second opening of the pair of openings in the reinforcing panel comprises a length that extends between opposite first and second tapered ends of the second opening in the reinforcing panel, and a width that extends crosswise to the longitudinal direction, and is smaller, than the length of the second opening in the reinforcing panel;

a third elongate extension cut out extends from the first tapered end of the second opening of the pair of openings in the reinforcing panel;

a fourth elongate extension cut out extends from the second tapered end of the second opening of the pair of openings in the reinforcing panel;

for each elongate extension cut out of the third and fourth elongate extension cut outs, the elongate extension cut out is in the reinforcing panel, and the elongate extension cut out is wider than a slit;

the third elongate extension cut out has a length that extends from the first tapered end of the second opening in the reinforcing panel to an opposite end of the third elongate extension cut out, and a width that is smaller than both the length of the third elongate extension cut out, and the width of the second opening in the reinforcing panel; and the fourth elongate extension cut out has a length that extends from the second tapered end of the second opening in the reinforcing panel to an opposite end of the fourth elongate extension cut out, and a width that is smaller than both the length of the fourth elongate extension cut out, and the width of the second opening in the reinforcing panel.

16. A carton comprising:

a plurality of adjoining panels extending around an interior of the carton and including at least a first panel comprising a pair of handle openings defining a handle therebetween;

a reinforcing panel superposed with the first panel so that the reinforcing panel is positioned between the first panel and the interior of the carton, the reinforcing panel comprising a pair of reinforcing openings defining a reinforcing handle therebetween, the handle openings being respectively aligned with the reinforcing openings;

a first reinforcing opening of the pair of reinforcing openings including a length that extends between opposite first and second tapered ends of the first reinforcing opening, so that the length extends from the first tapered end to the second tapered end, and a width positioned between and located distant from the tapered ends, wherein the width extends across, and is smaller than, the length; and a first elongate extension cut out positioned in the reinforcing panel and extending from the first tapered end of the first reinforcing opening of the pair of reinforcing openings, wherein the first elongate extension cut out is wider than a slit, the first elongate extension cut out has a length that extends from the first tapered end of the first reinforcing opening to an opposite end of the first elongate extension cut out, and a width that is smaller than both the length of the first elongate extension cut out, and the width of the first reinforcing opening; and the first panel being mounted to the reinforcing panel and covering the first elongate extension cut out so that the first elongate extension cut out is positioned between the first panel and the interior of the carton.

17. The carton of claim 16, wherein each of the reinforcing openings has dimensions substantially identical to dimensions of each of the handle openings.

18. The carton of claim 17, wherein a width of the handle is greater than or equal to a width of the reinforcing handle.

19. The carton of claim 18, wherein each reinforcing opening has dimensions greater than each handle opening.

20. The carton of claim 18 in combination with containers, the carton comprising an exiting end capable of permitting the containers to exit the carton, and the containers are arranged in the carton in at least two rows, with the two rows comprising a top and a bottom row.

21. The carton of claim 20, wherein the handle comprises a pair of cushioning flaps, each cushioning flap being foldably joined at one side of the handle.

22. The carton of claim 20, wherein the first elongate extension cut out extends obliquely to the length of the first reinforcing opening in the reinforcing panel.

23. The carton of claim 16, wherein:

a second reinforcing opening of the pair of reinforcing openings includes a length that extends between opposite first and second tapered ends of the second reinforcing opening, and a width positioned between and located distant from the tapered ends of the second reinforcing opening, wherein the width of the second reinforcing opening extends across, and is smaller than, the length of the second reinforcing opening;

a second elongate extension cut out is positioned in the reinforcing panel and extends from the first tapered end of the second reinforcing opening of the pair of reinforcing openings;

the second elongate extension cut out is wider than a slit;

the second elongate extension cut out has a length that extends from the first tapered end of the second reinforcing opening to an opposite end of the second elongate extension cut out, and a width that is smaller than both the length of the second elongate extension cut out, and the width of the second reinforcing opening; and the first panel covers the second elongate extension cut out so that second elongate extension cut out is positioned between the first panel and the interior of the carton.

24. The carton of claim 23, wherein:

a third elongate extension cut out extends from the second tapered end of the first reinforcing opening of the pair of reinforcing openings;

the third elongate extension cut out is wider than a slit;

the third elongate extension cut out has a length that extends from the second tapered end of the first reinforcing opening to an opposite end of the third elongate extension cut out, and a width that is smaller than both the length of the third elongate extension cut out, and the width of the first reinforcing opening;

a fourth elongate extension cut out extends from the second tapered end of the second reinforcing opening of the pair of reinforcing openings;

the fourth elongate extension cut out has a length that extends from the second tapered end of the second reinforcing opening to an opposite end of the fourth elongate extension cut out, and a width that is smaller than both the length of the fourth elongate extension cut out, and the width of the second reinforcing opening; and for each elongate extension cut out of the third and fourth elongate extension cut outs, the first panel covers the elongate extension cut out so that the elongate extension cut out is positioned between the first panel and the interior of the carton.

25. The carton of claim 24, wherein:

the reinforcing handle includes opposite first and second ends;

the first and second elongate extension cut outs extend away from the first end of the reinforcing handle;

the first and second elongate extension cut outs diverge from one another as the first and second elongate extension cut outs extend away from the first end of the reinforcing handle;

the third and fourth elongate extension cut outs extend away from the second end of the reinforcing handle; and the third and fourth elongate extension cut outs diverge from one another as the third and fourth elongate extension cut outs extend away from the second end of the reinforcing handle.

26. The carton of claim 23, wherein:

the first and second elongate extension cut outs extend away from an end of the reinforcing handle; and the first and second elongate extension cut outs diverge from one another as the first and second elongate extension cut outs extend away from the end of the reinforcing handle.

27. A carton blank, comprising:

a plurality of panels respectively foldably connected to one another, the plurality of panels including opposite first and second ends;

a first panel foldably connected to the first end of the plurality of panels, the first panel including a handle opening;

a second panel foldably connected to the second end of the plurality of panels, the second panel including a reinforcing opening having a length that extends between opposite first and second tapered ends of the reinforcing opening, so that the length extends from the first tapered end to the second tapered end, and a width positioned between and located distant from the tapered ends, wherein the width extends across, and is smaller than, the length of the reinforcing opening, and an elongate extension cut out extending from the first tapered end of the reinforcing opening, wherein the elongate extension cut out is in the second panel, the elongate extension cut out is wider than a slit, and the elongate extension cut out has a length that extends from the first tapered end of the reinforcing opening to an opposite end of the elongate extension cut out, and a width that is smaller than both the length of the elongate extension cut out, and the width of the reinforcing opening; and the handle opening and the reinforcing opening being arranged for being substantially superposed with one another when the blank is erected into the carton.

28. A carton erected from the blank of claim 27, wherein the first and second panels are superposed with respect to one another so that the handle opening and the reinforcing opening are substantially superposed with one another.

29. The carton blank of claim 27, wherein:

the reinforcing opening is a first reinforcing opening;

the elongate extension cut out is a first elongate extension cut out;

the second panel further includes a second reinforcing opening having a length that extends between opposite first and second tapered ends of the second reinforcing opening, and a width positioned between and located distant from the tapered ends of the second reinforcing opening, wherein the width extends across, and is smaller than, the length of the second reinforcing opening, and a second elongate extension cut out extending from the first tapered end of the second reinforcing opening;

the second elongate extension cut out is in the second panel;

the second elongate extension cut out is wider than a slit;

the second elongate extension cut out has a length that extends from the first tapered end of the second reinforcing opening to an opposite end of the second elongate extension cut out, and a width that is smaller than both the length of the second elongate extension cut out, and the width of the second reinforcing opening, a reinforcing handle is positioned between the first and second reinforcing openings;

the first and second elongate extension cut outs extend away from the reinforcing handle; and the first and second elongate extension cut outs diverge from one another as the first and second elongate extension cut outs extend away from the reinforcing handle.

* * * * *